United States Patent [19]

Clark

[11] Patent Number: 4,866,867

[45] Date of Patent: Sep. 19, 1989

[54] CARD HOLDER ASSEMBLY FOR PAYSTATIONS

[75] Inventor: Kenneth H. Clark, Hemet, Calif.

[73] Assignee: General Telephone Company of California, Thousand Oaks, Calif.

[21] Appl. No.: 91,553

[22] Filed: Aug. 31, 1987

[51] Int. Cl.[4] ..... G09F 3/18

[52] U.S. Cl. ..... 40/642; 40/584; 40/607

[58] Field of Search ..... 40/10 R, 607, 584, 642

[56] References Cited

U.S. PATENT DOCUMENTS

| | | | |
|---|---|---|---|
| 226,474 | 4/1880 | Baker | 40/10 R |
| 558,365 | 4/1896 | Duggan | 40/10 R |
| 4,176,486 | 12/1979 | Williams | 40/607 |
| 4,706,399 | 11/1987 | Martin | 40/584 |

*Primary Examiner*—Gene Mancene
*Assistant Examiner*—Wenceslao J. Contreras
*Attorney, Agent, or Firm*—John A. Odozynski

[57] ABSTRACT

A card holder assembly for holding a dialing instruction card for a paystation telephone includes a monolithic bracket that exhibits a planar forwardmost surface to which a card holder is attached. The bracket also exhibits a lateral surface oriented orthogonally to the forwardmost surface and arranged to be positioned alongside the paystation telephone. A ligamentary portion joins the lateral surface to a bracketing surface that includes a mounting notch for supporting the bracketing surface, and, thereby, the entire card holder assembly, on a mounting surface such as the rear wall of the paystation booth. A card holder, configured to have a perimeter conforming to the perimeter of the forwardmost surface, is attached to the forwardmost surface by virtue of hardware inserted through access holes that align with mounting holes in the forwardmost surface. The card holder exhibits rearwardly extending flanges that provide mounting holes in alignment with the access holes and with the mounting holes of the forwardmost surface so that the hardware may be recessed with respect to a planar surface of the card holder. A removable retention section is attached to the card holder at a bottom side so as to secure dialing instruction cards or other material.

33 Claims, 2 Drawing Sheets

CARD HOLDER ASSEMBLY FOR PAYSTATIONS

FIELD OF THE INVENTION

The invention relates to paystation telephone equipment and, more particularly, to a card holder assembly to be attached to a paystation telephone for holding a dialing instruction card or other material.

BACKGROUND OF THE INVENTION

In order for a customer to successfully place a call at a paystation telephone, the customer must comply with dialing conventions imposed by the telephone service provider. The required dialing procedures are made known to the customer by a dialing instruction card or equivalent material placed at the paystation. As a result, the paystation must be equipped with hardware for securing and retaining the dialing instruction card.

What is desired, therefore, is a hardware applique into which a dialing instruction card may be placed and be protected. It is necessary that the hardware be easily installed, preferably without requiring removal of the telephone box. Furthermore, the hardware should be amenable to use in various types of paystation equipment and booth configurations. Specifically, the applique should be useable in paystations comprising either fully exposed or recessed telephones.

DISCLOSURE OF THE INVENTION

The above and other objects, advantages, and capabilities are achieved in one aspect of the invention by a card holder assembly for a paystation telephone. The card holder assembly includes a monolithic bracket that exhibits a planar forwardmost surface to which a card holder is attached. The bracket also exhibits a lateral surface oriented orthogonally to the forwardmost surface and arranged to be positioned alongside the paystation telephone. A ligamentary portion joins the lateral surface to a bracketing surface that includes a mounting notch for supporting the bracketing surface, and, thereby, the entire card holder assembly, on a mounting surface such as the rear wall of the paystation booth. A removable retention member is attached to the card holder at a bottom side so as to secure a dialing instruction card or other material.

DESCRIPTION OF A PREFERRED EMBODIMENT

For a better understanding of the subject card holder assembly, refer to the following description and appended claims in conjunction with the above-described drawings.

Figure 1:
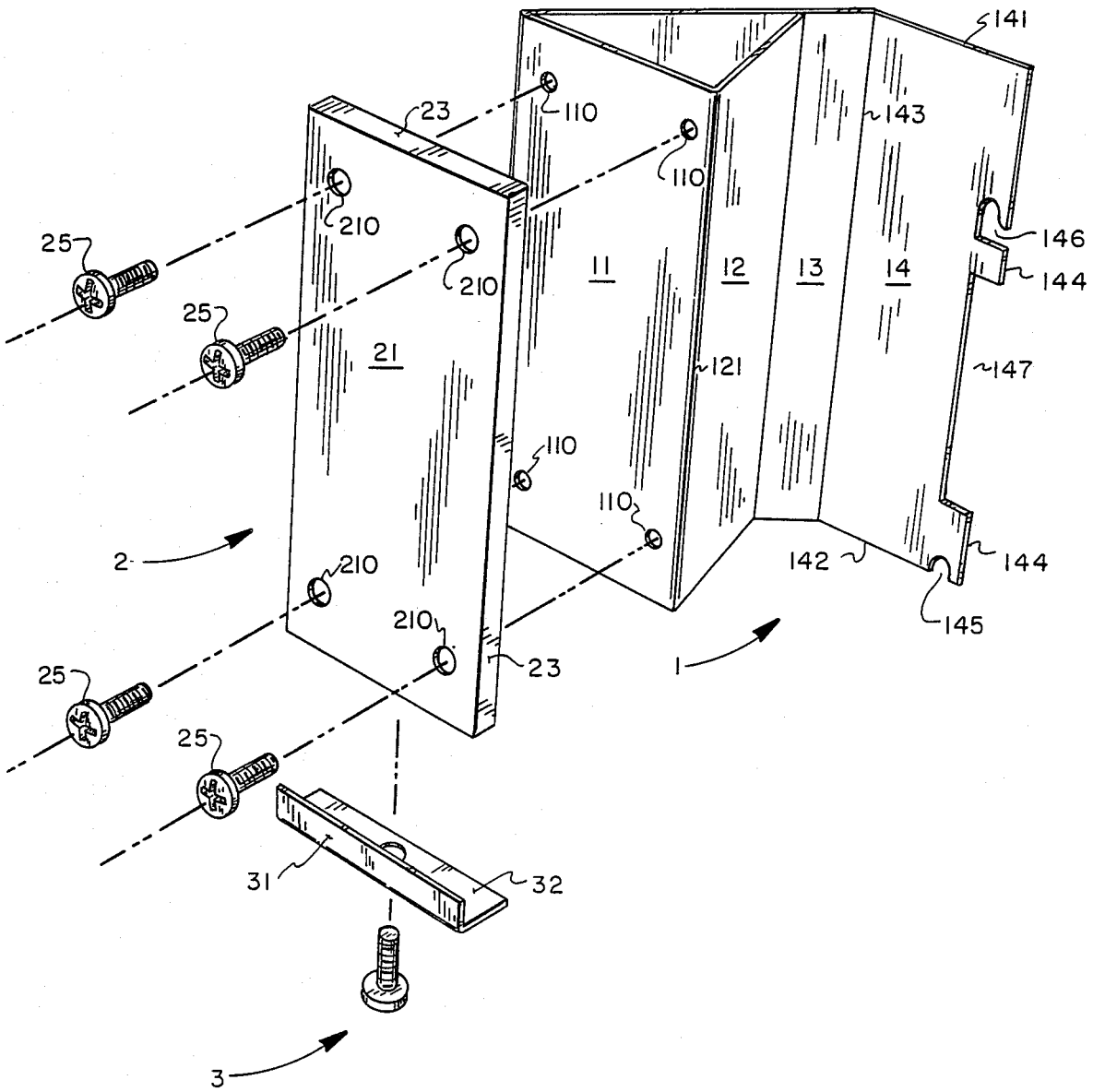
FIG. 1 is an exploded isometric view of the subject card holder assembly.

Referring now to FIG. 1, the subject card holder assembly can be seen to include a monolithic bracket 1, a card holder 2, and a retention member 3. Bracket 1 includes a planar, forwardmost surface 11 characterized by a rectangular perimeter and including four mounting holes 110. The mounting holes are disposed symmetrically about an imaginary center point defined by the intersection of diagonals drawn between the upper-left and lower-right corners and the upper-right and lower-left corners of forwardmost surface 11. A lateral surface 12 joins surface 11 at an edge 121. Surfaces 11 and 12 are oriented so that their respective planes are mutually orthogonal. Bracket 1 also includes a bracketing surface 14 having a generally rectangular perimeter defined by a top side 141, a bottom side 142, an interior side 143, and an exterior side 144. The bottom side 142 exhibits a first mounting notch 145 cut out from the bracketing surface and extending upwardly from bottom side 142. Exterior side exhibits a second mounting notch 146 cut out from the exterior side 144 of the bracketing surface and extending inwardly from side 144 and then upwardly. Exterior side 144 also exhibits a rectangular cut out section 147.

Bracketing surface 14 is joined to lateral surface 12 via a relatively narrow ligamentary surface 13.

Figure 2A:
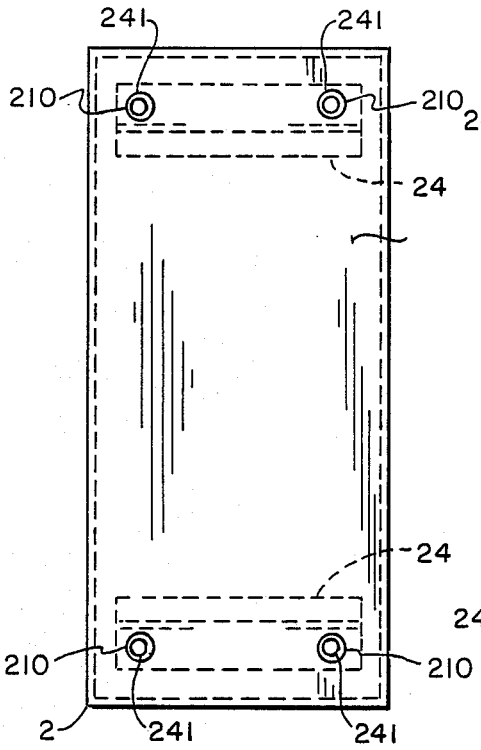
FIGS. 2A–2C show front, back, and side detailed renditions, respectively, of the card holder.
Figure 2B:
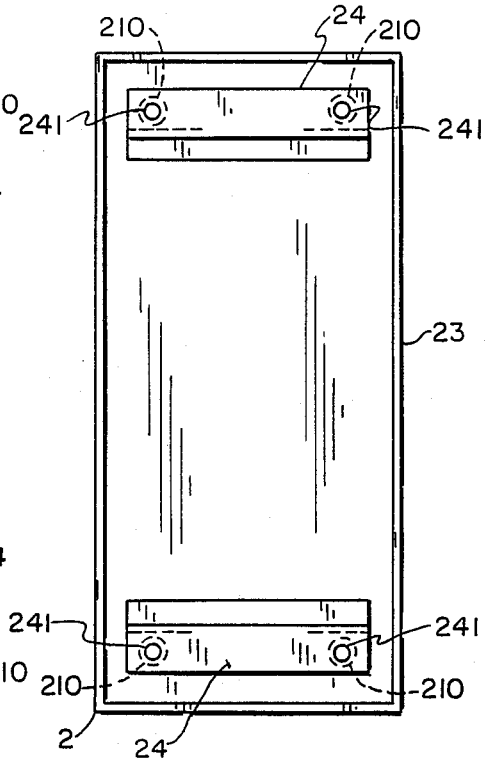
Figure 2C:
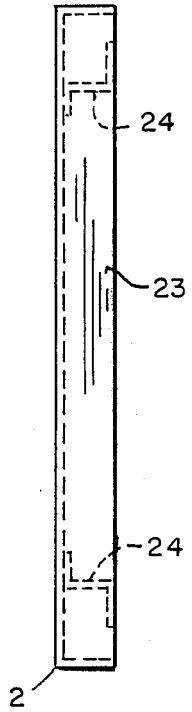

Card holder 2, depicted in detail in FIGS. 1 and 2, is characterized by a planar surface 21 having a substantially rectangular perimeter. The perimeter of surface 21 conforms generally to the perimeter of surface 11, and, in practice, is preferred to extend somewhat beyond the perimeter of surface 11. Surface 21 includes four access holes 210 disposed symmetrically about an imaginary center point. Access holes 210 are positioned to align with the mounting holes 110, but are preferred to have a greater diameter. Card holder 2 also exhibits a rectangular lip 23 formed integrally with surface 21 and extending rearwardly from surface 21, about its perimeter. In addition, the card holder 2 exhibits a pair of mounting flanges 24 disposed rearwardly from planar surface 21. The mounting flanges each exhibit a pair of mounting holes 241 that align with access holes 210. This arrangement allows mounting hardware, such as sheet metal screws 25, to be inserted through the access holes and threaded into the flange mounting holes.

With reference to FIG. 1, the card holder assembly also includes a retention member 3 that is attached to a bottom side of card holder 2. Retention member 3 consists of a vertical section 31 and a horizontal section 32 orthogonally arranged to form an L-shaped cross section. Retention member 3 is attached to the card holder through mounting hardware in the form of a sheet metal screw and may be removed to permit the placement of a dialing instruction card into the card holder, contiguous to planar surface 21.

When fully assembled, card holder 2 is attached to surface 11 of the bracket via mounting hardware inserted into access holes 210 and threaded through flange mounting holes 241 and into mounting holes 110.

Figure 3A:
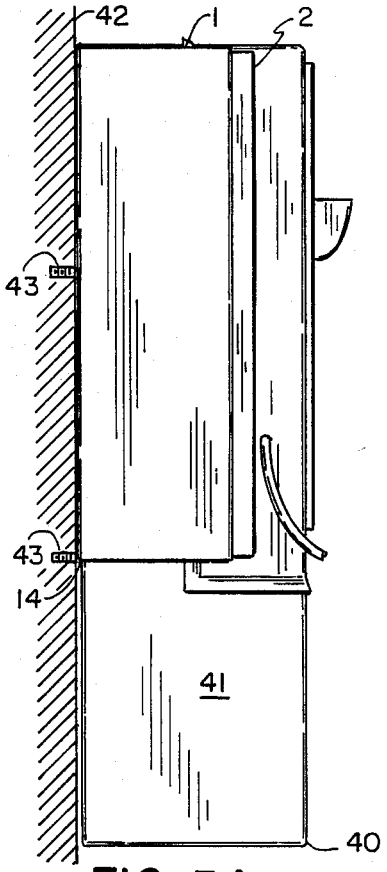
FIGS. 3A and 3B show side and front views, respectively, of the card holder assembly as it appears when installed in conjunction with a fully exposed telephone box.
Figure 3B:
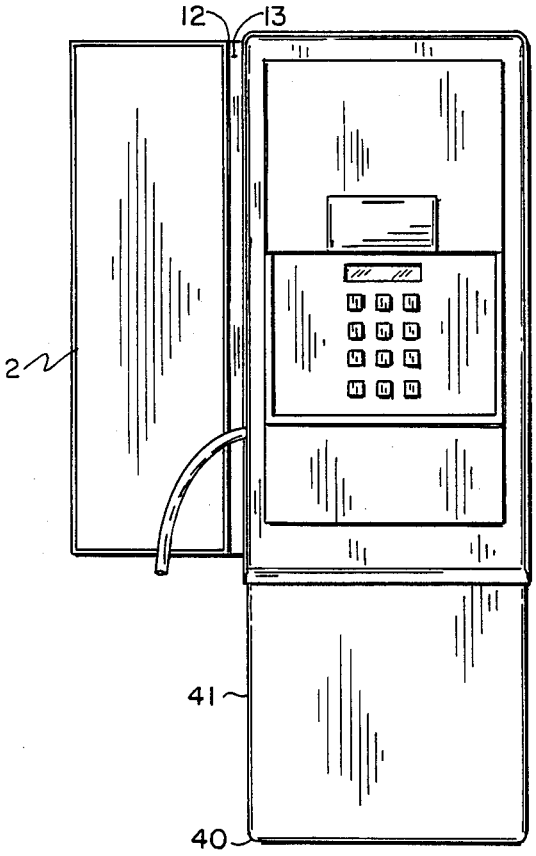

The card holder assembly is then placed in juxtaposition with a paystation telephone 40 so that lateral surface 12 is positioned adjacent and substantially parallel to a side 41 of the telephone. Bracketing surface 14 is then inserted behind the telephone 40 between the telephone 40 and a mounting rear wall 42 of the booth. Insertion of bracketing surface 14 may be accomplished by simply loosening the telephone box mounting screws 43 to a degree sufficient to permit bracketing surface 14 to be inserted behind the telephone box. The bracket is positioned so that mounting notch 145 and mounting notch 146 surround the telephone box mounting screws 43. The card holder assembly is, in this fashion, supported by the mounting screws 43. FIGS. 3A and 3B depict the card holder assembly as it appears when fully installed in a paystation configured with a fully exposed telephone box.

The card holder may also be used in conjunction with paystations accommodating recessed telephone boxes. Given this configuration, the bracket 1 is not required and the card holder 2 can be mounted directly on the wall alongside the telephone box.

To reiterate, the subject invention encompasses a card holder assembly that makes dialing instruction cards easily discernable to users of telephone paystations. The assembly includes a card holder that is easily attached to the monolithic bracket. The cardholder is configured to have a perimeter that conforms to the perimeter of the forwardmost surface of the bracket and provides access holes aligned to the mounting holes in the bracket. The rearwardly extending flanges permit recessed placement of the mounting hardware. Dialing instruction cards are easily inserted or replaced by virtue of the removable retention member. The mounting notches cut out from the rearwardmost (bracketing) surface of the bracket allow the card holder assembly to be easily installed by simply loosening bolts used to support the telephone on a mounting surface, that is, on the rear wall of a telephone booth. The card holder can be used in conjunction with the bracket or can be mounted alone on a wall of the phone booth.

These salutary features of the card holder assembly are achieved in the configuration described in detail above. It is understood that minor departures may be made from that configuration without detriment to those features. Accordingly, while there has been shown and described what, at present, appears to be the preferred embodiment of a card holder assembly for a paystation telephone, it will be obvious to those acquainted with the design of such facilities that various changes and modifications may be made therein without departure from the scope of this invention as defined by the appended claims.

What is claimed is:

1. A card holder assembly for retaining a dialing instruction card or other material associated with a paystation telephone, the assembly comprising:

a monolithic bracket exhibiting (i) a planar forwardmost surface that includes a plurality of mounting holes, (ii) a lateral surface oriented substantially orthogonal to the forwardmost surface, joining said forwardmost surface, extending rearward from said forwardmost surface and arranged to be positioned adjacent to the paystation telephone, (iii) a bracketing surface that includes a mounting notch for supporting the bracket on a mounting screw and that is arranged to be positioned rearward and offset from said forwardmost surface so that the bracketing surface can reside behind a rear surface of the paystation telephone while the forwardmost surface resides beside the paystation telephone, and (iv) a ligamentary portion joining the lateral surface to the bracketing surface;

a card holder attached to the forwardmost surface of the bracket and exhibiting a planar surface, a plurality of access holes disposed in the planar surface and aligned with the mounting holes of the forwardmost surface of the bracket; and a retention member removably attached to the card holder at a bottom side of the card holder, the retention member for the placement and support of a dialing instruction card or other material.

2. A card holder assembly as defined in claim 1 wherein the forwardmost surface of the bracket has a rectangular perimeter and includes four mounting holes symmetrically disposed about a center point thereof.

3. A card holder assembly as defined in claim 1 wherein the bracketing surface exhibits a generally rectangular perimeter defined by a top side, a bottom, side, an interior side, and an exterior side.

4. A card holder assembly as defined in claim 3 wherein the bottom side exhibits the mounting notch cut out upwardly therefrom.

5. A card holder assembly as defined in claim 4 wherein the exterior side exhibits a second mounting notch cut out inwardly and upwardly therefrom.

6. A card holder assembly as defined in claim 5 wherein the exterior side exhibits a rectangular cut out section.

7. A card holder assembly as defined in claim 6 wherein the forwardmost surface has a rectangular perimeter and includes four mounting holes symmetrically disposed about a center point of the forwardmost surface.

8. A card holder assembly as defined in claim 3 wherein the exterior side exhibits the mounting notch cut out inwardly and upwardly therefrom.

9. A card holder assembly as defined in claim 8 wherein the exterior side exhibits a rectangular cut out section.

10. A card holder assembly as defined in claim 9 wherein the bottom side exhibits a second mounting notch cut out upwardly therefrom.

11. A card holder assembly as defined in claim 10 wherein the forwardmost surface has a rectangular perimeter and includes four mounting holes symmetrically disposed about a center point of the forwardmost surface.

12. A card holder assembly as defined in claim 1 wherein the card holder comprises a mounting flange disposed rearwardly from the planar surface of the card holder, the flange exhibiting a mounting hole aligned with one of the access holes of the planar surface so that mounting hardware may be inserted through the one access hole of the planar surface, through the mounting hole of the flange, and into one of the mounting holes of the forwardmost surface of the bracket.

13. A card holder assembly as defined in claim 12 wherein the forwardmost surface of the bracket includes four mounting holes symmetrically disposed about a center point of the forwardmost surface, and the card holder planar surface includes four access holes aligned with the mounting holes of the forwardmost surface of the bracket.

14. A card holder assembly as defined in claim 13 wherein the card holder comprises a pair of flanges each exhibiting a pair of mounting holes, each of the mounting holes of the flanges arranged so as to align with an access hole of the card holder planar surface and with a corresponding mounting hole of the forwardmost surface of the bracket.

15. A card holder assembly as defined in claim 1 wherein the retention member consists of a vertical section and a horizontal section that join to define an L-shaped cross section.

16. A card holder assembly as defined in claim 15 wherein the retention member is attached to the card holder via hardware inserted through the horizontal section.

17. A card holder assembly as defined in claim 16 wherein the vertical section extends upwardly from a bottom side of the card holder so as to support and retain dialing instruction cards or other material inserted into the card holder.

18. In a card holder assembly for retaining a dialing instruction card or other material associated with a paystation telephone, a monolithic bracket comprising:

a planar forwardmost surface that includes a plurality of mounting holes;

a lateral surface oriented substantially orthogonal to the forwardmost surface, joining said forwardmost surface and extending rearward from said forwardmost surface substantially parallel to a side of the paystation telephone;

a bracketing surface that includes a mounting notch for supporting the bracket on a mounting screw and that is arranged to be positioned rearward and offset from said forwardmost surface so that the bracketing surface can reside behind a rear surface of the paystation telephone while the forwardmost surface resides beside the paystation telephone; and a ligamentary portion joining the lateral surface to the bracketing surface.

19. A bracket as defined in claim 18 wherein the bracketing surface exhibits a generally rectangular perimeter defined by a top side, a bottom side, an interior side, and an exterior side and wherein the bottom side exhibits the mounting notch cut out upwardly therefrom.

20. A bracket as defined in claim 19 wherein the exterior side exhibits (i) a second mounting notch cut out inwardly and upwardly therefrom and (ii) a rectangular cut out section.

21. A bracket as defined in claim 20 wherein the forwardmost surface has a rectangular perimeter and includes four access holes symmetrically disposed about a center point of the forwardmost surface.

22. A bracket as defined in claim 18 wherein the forwardmost surface has a rectangular perimeter and includes four access holes symmetrically disposed about a center point of the forwardmost surface.

23. A bracket as defined in claim 22 wherein the bracketing surface exhibits a generally rectangular perimeter defined by a top side, a bottom side, an interior side, and an exterior side and wherein the bottom side exhibits the mounting notch cut out upwardly therefrom.

24. A bracket as defined in claim 23 wherein the exterior side exhibits (i) a second mounting notch cut out inwardly and upwardly therefrom and (ii) a rectangular cut out section.

25. A card holder for retaining a dialing instruction card or other material associated with paystation telephones, the card holder comprising:

a planar surface exhibiting a plurality of access holes disposed in the planar surface about a center point thereof;

a rectangular lip extending rearwardly from the planar surface and about its perimeter; and a mounting flange attached to and disposed rearwardly from the planar surface and exhibiting a mounting hole aligned with one of the access holes so that mounting hardware may be inserted through the access hole and into the mounting hole without protruding beyond the planar surface.

26. A card holder as defined in claim 25 further comprising a retention member removably attached to the rectangular lip at a bottom side thereof.

27. A card holder as defined in claim 26 wherein the retention member consists of a vertical section and a horizontal section that join to define an L-shaped cross section.

28. A card holder as defined in claim 27 wherein the retention member is attached to the rectangular lip via hardware inserted through the horizontal section.

29. A card holder as defined in claim 28 wherein the vertical section extends upwardly from a bottom side of the rectangular lip so as to support and retain a dialing instruction card or other material inserted into the card holder.

30. A card holder as defined in claim 26 and comprising a pair of mounting flanges, each exhibiting a pair of mounting holes, each of the mounting holes individually arranged to align with an access hole.

31. A card holder as defined in claim 30 wherein the retention member consists of a vertical section and a horizontal section that join to define an L-shaped cross section.

32. A card holder as defined in claim 31 wherein the retention member is attached to the rectangular lip via hardware inserted through the horizontal section.

33. A card holder as defined in claim 32 wherein the vertical section extends upwardly from a bottom side of the rectangular lip so as to support and retain dialing instruction card or other material inserted into the card holder.

* * * * *